United States Patent [19]

Müller

[11] 4,052,052

[45] Oct. 4, 1977

[54] APPARATUS FOR FEEDING AND TRANSPORTING SIGNATURES IN BOOKBINDING MACHINES

[75] Inventor: Hans Müller, Zofingen, Switzerland

[73] Assignee: Grapha-Holding AG, Hergiswil, Switzerland

[21] Appl. No.: 719,578

[22] Filed: Sept. 1, 1976

[30] Foreign Application Priority Data

Sept. 9, 1975 Switzerland ..... 11697/75

[51] Int. Cl.[2] ..... B65H 1/30

[52] U.S. Cl. ..... 271/157; 271/150

[58] Field of Search ..... 271/30 A, 129, 149, 271/150, 157–160; 270/58; 214/8.5 A

[56] References Cited

U.S. PATENT DOCUMENTS

| | | | |
|---|---|---|---|
| 2,291,010 | 7/1942 | Vergobbi | 271/150 X |
| 2,928,558 | 3/1960 | Bamford et al. | 271/157 X |
| 3,149,835 | 9/1964 | Branscome | 271/150 |
| 3,881,718 | 5/1975 | Fernandez-Rana et al. | 271/150 X |
| 3,915,338 | 10/1975 | Kronseder et al. | 271/149 X |

*Primary Examiner*—Robert W. Saifer
*Attorney, Agent, or Firm*—Peter K. Kontler

[57] ABSTRACT

Apparatus for converting successive stacks of condensed parallel signatures into a single file of signatures which are thereupon processed in a bookbinding machine has a chain conveyor the front portion of which supports and advances an expiring stack of signatures. Successive foremost signatures of the expiring stack are withdrawn by a mechanism which transfers them onto a further conveyor. The horizontal rear portion of the chain conveyor is long enough to support at least one full stack of signatures behind the expiring stack. A fresh stack of signatures is placed onto a platform forming part of a carriage and movable between a raised position in which the platform is located above the rear portion of the chain conveyor to receive a fresh stack and a lower position in which the platform is located below the rear portion of the chain conveyor so that the fresh stack comes to rest on the rear portion. The carriage is movable lengthwise of the rear portion of the chain conveyor to allow for movement of the foremost signature of the fresh stack into abutment with the rearmost signature of the expiring stack before the platform is lowered to allow for return movement of the carriage to a retracted position in which the platform can be lifted again to receive another fresh stack of signatures.

11 Claims, 3 Drawing Figures

APPARATUS FOR FEEDING AND TRANSPORTING SIGNATURES IN BOOKBINDING MACHINES

CROSS-REFERENCE TO RELATED APPLICATION

The apparatus of the present invention constitutes an improvement over and a further development of apparatus which is disclosed in my commonly owned copending application Ser. No. 702,138 filed July 2, 1976 for "Apparatus for manipulating signatures in bookbinding machines."

BACKGROUND OF THE INVENTION

The present invention relates to apparatus for feeding, transporting and manipulating sheets (especially groups of sheets in the form of book sections or signatures) in bookbinding machines. More particularly, the invention relates to improvements in apparatus of the type wherein a first conveyor means transports stacks of sheets (hereinafter called stacks of signatures) to a location at which a suitable mechanism transfers successive signatures of a stack onto further conveyor means for introduction into the book assembling unit or units of the machine. Still more particularly, the invention relates to improvements in apparatus wherein fresh stacks of signatures are moved seriatim into abutment with the last signatures of the preceding (expiring) stacks to insure continuous delivery of signatures to the transferring mechanism.

U.S. Pat. No. 3,416,679, granted Dec. 17, 1968 to Gualandris et al., discloses an apparatus wherein two discrete chain or belt conveyors are driven independently of each other. One of the conveyors is in continuous motion and serves to deliver signatures into the range of the transferring mechanism. The other conveyor is started only when the supply of signatures on the one conveyor is nearly exhausted and serves to deliver a fresh stack of signatures. A drawback of such coventional apparatus is that they are quite complex, expensive and prone to malfunction. Moreover, an unskilled or careless operator is likely to start the wrong conveyor at an inopportune time; this invariably entails long-lasting interruptions in operation of the bookbinding machine.

SUMMARY OF THE INVENTION

An object of the invention is to provide a simple, rugged and relatively inexpensive apparatus which can deliver signatures to a transfer station at a predictable and reproducible rate for any desired interval of time.

Another object of the invention is to provide an apparatus which can be installed in existing bookbinding and like machines as a superior substitute for existing signature feeding and transporting apparatus.

A further object of the invention is to provide the apparatus with novel and improved means for advancing a fresh stack of signatures into abutment with the last signature of the expiring stack.

An additional object of the invention is to provide the apparatus with novel and improved means for actuating the advancing means at desired intervals.

One feature of the invention resides in the provision of an apparatus for manipulating signatures in bookbinding machines wherein successive signatures of an expiring stack of parallel signatures are converted into a succession of discrete signatures. The apparatus comprises conveyor means (preferably a composite chain conveyor) having a preferably downwardly sloping front portion which can support and advance an expiring stack of signatures and a substantially horizontal elongated rear portion, a frame or an analogous mounting means which supports the conveyor means, and a carriage which is mounted in the frame in the region of the rear portion of the conveyor means and has a substantially horizontal support (e.g., a platform provided with one or more roller conveyors) adapted to carry at least one fresh stack of signatures. The carriage is movable back and forth lengthwise of the rear portion of the conveyor means, and the apparatus further comprises a fluid-operated motor or other suitable means for moving the support up and down with respect to the frame between a raised position in which the support is located at a level above the rear portion of the conveyor means and a fresh stack which is then placed onto the support can be moved with the carriage toward the expiring stack on the front portion of the conveyor means, and a lower position in which the support is located at a level below the rear portion of the conveyor means whereby a fresh stack which has been placed onto the support in the raised position of such support comes to rest on the rear portion of the conveyor means and the carriage can be moved away from the front portion of the conveyor means to a position in which the support can be raised again to receive another fresh stack, either immediately or subsequent to partial exhaustion of the preceding fresh stack.

The novel features which are considered as characteristic of the invention are set forth in particular in the appended claims. The improved apparatus itself, however, both as to its construction and its mode of operation, together with additional features and advantages thereof, will be best understood upon persual of the following detailed description of certain specific embodiments with reference to the accompanying drawing.

DESCRIPTION OF THE PREFERRED EMBODIMENTS

Figure 1:
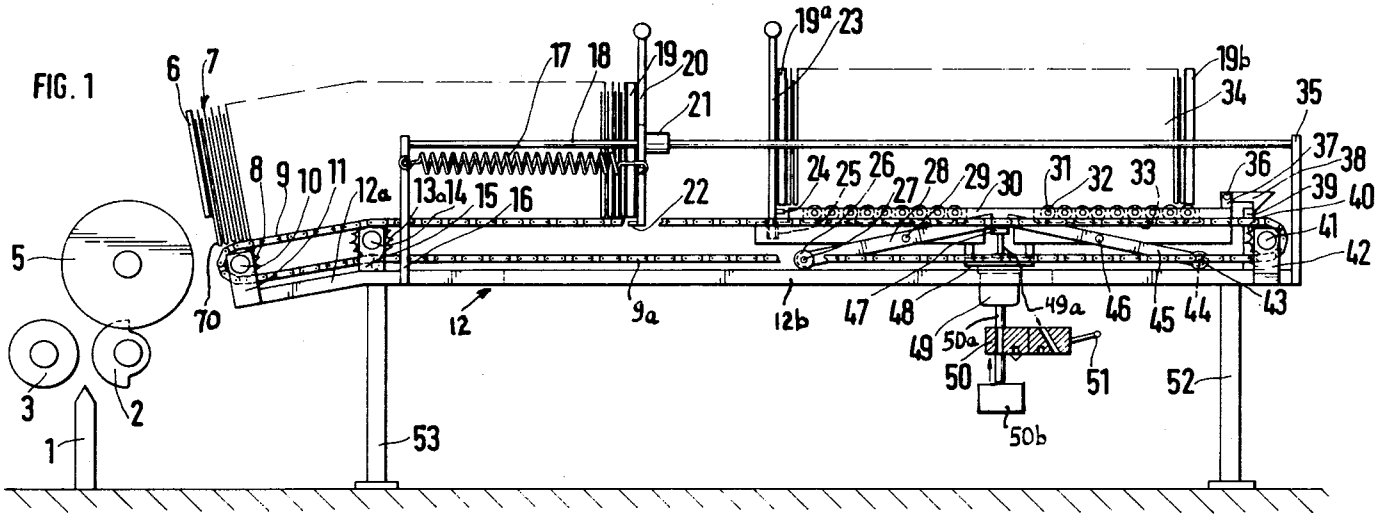
FIG. 1 is a schematic side elevational view of an apparatus which embodies the invention.
Figure 2:
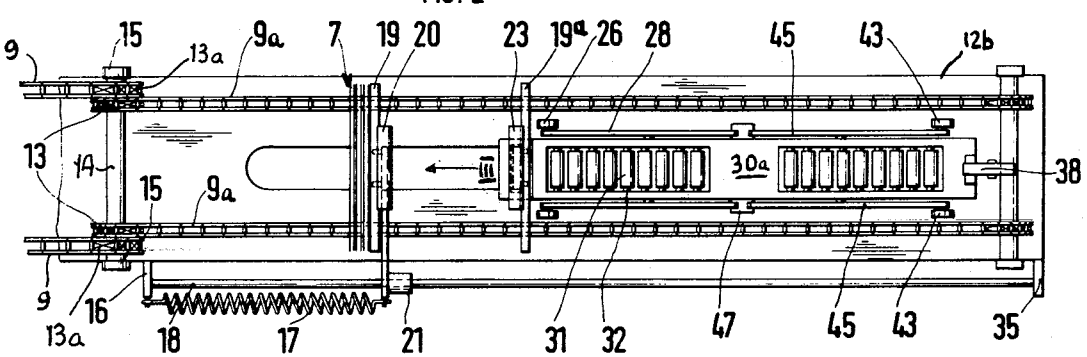
FIG. 2 is a plan view of a portion of the apparatus of FIG. 1.

Referring to FIGS. 1 and 2, there is shown an apparatus which is installed in a bookbinding machine and serves to deliver signatures 70 to a conveyor 1 whereon the signatures form a file moving at right angles to the plane of FIG. 1. The mechanism which transfers successive signatures 70 from an expiring stack 7 of signatures onto the conveyor 1 comprises a rotary drum-shaped member 5 having grippers or claws (not shown) which receive successive signatures from a mobile suction head of the type disclosed in the aforementioned commonly owned copending application Ser. No. 702,138. The claws of the rotary member 5 deliver successive signatures into the nip of two rotary opening members 2, 3 which open the signatures and enable each signature to ride on the adjacent portion of the conveyor 1 during further transport through the bookbinding machine. The manner in which the signatures 70 are thereupon processed (e.g., assembled with other signatures and bound together to form books, pamphlets, brochures, magazines or the like) forms no part of the present invention.

The apparatus comprises an elongated frame 12 which is mounted on ground-contacting legs 52, 53 and is provided with three pairs of bearing members or brackets 11, 15 and 42. The front portion 12*a* of the frame 12 slopes downwardly toward the rotary member 5, and the rear portion 12*b* of the frame 12 is horizontal or nearly horizontal. The pairs of bearing members 11 and 15 respectively support horizontal shafts 10 and 14 for pairs of sprocket wheels 8 and 13*a*. Endless chains or analogous flexible elements 9 are trained around the sprocket wheels 8 and 13*a*, and their upper reaches slope downwardly toward the rotary member 5. The chains 9 are disposed in two parallel vertical planes and are located above the front portion 12*a* of the frame 12. The shaft 10 is driven by a motor (not shown), for example, in a manner as disclosed in the aforementioned application Ser. No. 702,138.

The shaft 14 further carries two additional sprocket wheels 13 for two endless flexible elements or chains 9*a* which are located above the rear portion 12*b* of the frame 12. The chains 9*a* are further trained over sprocket wheels 40 on a shaft 41 which is journalled in the bearing members 42 at the rear end of the frame 12. The chains 9 constitute the front portion and the chains 9*a* constitute the elongated rear portion of a composite chain conveyor. FIG. 2 shows that the chains 9*a* are spaced apart from each other and are located in two parallel vertical planes.

The foremost signature 70 of the expiring stack 7 abuts against a fixed plate-like arresting member or stop 6 which is adjacent to the rotary member 5 of the transferring mechanism. The expiring stack 7 rests on the chains 9 and on the front portions of upper reaches of the chains 9*a*. That portion of the stack 7 which is located at a level above the shaft 14 for the sprocket wheels 13 and 13*a* is loosened as a result of inclination of the upper reaches of chains 9 with respect to the upper reaches of the chains 9*a* to enable the aforementioned suction head to withdraw the foremost signature 70 of the stack 7 from the space behind the arresting member 6 and to deliver the thus withdrawn signature into the range of a claw on the rotary member 5. The spreading or loosening of signatures 70 in the expiring stack 7 can be further enhanced by adjustable screws or analogous spreading elements in a manner as fully disclosed in the copending application Ser. No. 702,138. The aforementioned motor preferably drives the shaft 10 intermittently, namely whenever the pressure of the foremost signature 70 against the arresting member 6 decreases to a preselected minimum value.

Figure 3:
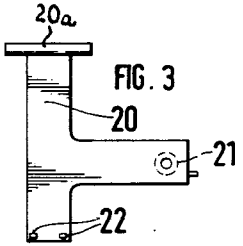
FIG. 3 is a side elevational view of a pusher in the apparatus of FIG. 1, substantially as seen in the direction of arrow III shown in FIG. 2.

The rear portion 12*b* of the frame 12 supports two outwardly extending bearing brackets 16 and 35 for an elongated guide rod 18. The latter supports a slidable and turnable bearing sleeve 21 for a plate-like pusher 20 which is biased forwardly by a helical spring 17. The foremost convolution of the spring 17 is attached to the bracket 16. The guide rod 18 is outwardly adjacent to the lower chain 9*a*, as viewed in FIG. 2. The configuration of the pusher 20 is shown in FIG. 3. This pusher comprises a handle 20*a* which can be grasped by hand to pivot the pusher to the first or operative position of FIG. 1 or 2 in which the pusher is located behind the rearmost signature 70 of the expiring stack 7 and a second or inoperative position in which the pusher 20 is located above or at one side of the stack 7 (as viewed in FIG. 1), i.e., below the rod 18, as viewed in FIG. 2. The pusher 20 further comprises two forwardly extending portions or projections 22 which are located at a level below the rearmost signatures 70 of the expiring stack 7 when the pusher assumes its operative position. In such operative position of the pusher 20, the projections 22 are located below the lower edge face of a plate-like insert 19 which is disposed between the pusher and the rearmost signature 70 of the expiring stack 7. The arrangement is such that the insert 19 shares the movements of the pusher 20 about the axis of the rod 18, i.e., the insert 19 is withdrawn when the pusher is moved to its inoperative position so that the foremost signature of a fresh stack 34 can be moved into abutment with the rearmost signature of the expiring stack 7.

In accordance with a feature of the invention, the means for receiving a fresh stack 34 in the region above the rear portion 12*b* of the frame 12 comprises a carriage 30 which is located in the space between the chains 9*a* and carries pairs of front and rear wheels or rollers 26 and 43 mounted on shafts 27 and 44. The shaft 27 for the front wheels 26 is mounted on the front arms of two-armed levers 28 which are pivotably mounted on the carriage 30 by means of horizontal pins 29. The shaft 44 for the rear wheels 43 is mounted on the rear arms of two-armed levers 45 which are pivotably mounted on the carriage 30 by means of pins 46. The wheels 26 and 43 can roll along suitable tracks on the rear frame portion 12*b*, i.e., the carriage 30 can be moved forwardly toward the expiring stack 7 on the chains 9 or rearwardly toward the shaft 41. The other arms of the levers 28 and 45 are adjacent to each other and rest on a motion transmitting member 47 which is provided at the upper end of the piston rod 49*a* forming part of a fluid-operated motor 49 (preferably a single-acting cylinder and piston unit). The motor 49 is suspended on a yoke 48 or an analogous support which is affixed to and shares the movements of the carriage 30.

The means for moving the piston rod 49*a* upwardly (whereby the levers 28 and 45 respectively pivot anticlockwise and clockwise, as viewed in FIG. 1) comprises a conduit 50*a* which is connected to a source 50*b* of pressurized fluid (e.g., compressed air) and contains a shutoff valve 50 which is normally closed but can be opened by an actuating member 51 to admit pressurized fluid into the chamber below the piston in the motor 49. The entire carriage 30 is then lifted above and away from the rear portion 12*b* of the frame 12. If the valve element of the valve 50 is moved to another position, the chamber of the motor 49 communicates with the atmosphere and is sealed from the source 50*b* so that the motion transmitting member 47 descends under the weight of the carriage 30.

The upper side of the platform or support 30*a* of the carriage 30 is formed with two aligned grooves or recesses 33 which extend in parallelism with the chains 9*a* and contain rows of rolls 32 which together constitute two simple roller conveyors 31. The rolls 32 allow for convenient shifting of a fresh stack 34 which rests on the roller conveyor 31, i.e., such stack can be moved lengthwise of the platform 30*a* with a minimum of effort.

The front end portion of the carriage 30 is formed with a socket 25 (e.g., a blind bore whose upper end is open) adapted to receive the lower end portion of a removable bar 23 or an analogous abutment member. The lower portion of the bar 23 carries one or more rearwardly extending portions or projections 24 which are located at a level below the lower edge face of a second insert 19*a* located in front of the foremost signature 70 of the fresh stack 34. When the bar 23 is lifted, it entrains the insert 19*a* so that the foremost signature 70 of the stack 34 can move into abutment with the rearmost signature of the partly exhausted expiring stack 7 in response to pivoting of the pusher 20 to its inoperative position. A further insert 19*b* is adjacent to the rearmost signature 70 of the fresh stack 34.

The rear portion 12*b* of the frame 12 further supports or includes a protuberance 39 (e.g., a tooth) which can be engaged by the pallet of a pawl 38 pivotably mounted on a shaft 36 which is journalled in bearing members 37 secured to the rear end portion of the carriage 30.

The operation:

The chains 9 and 9*a* of the composite chain conveyor are driven by the shaft 10, whenever necessary, so that the foremost signature 70 of the expiring stack 7 is always in an optimum position for transfer onto the conveyor 1. The rearmost signature 70 of the expiring stack 7 is urged forwardly by the insert 19 in front of the pusher 20 which is held in the operative position of FIG. 1 and moves forwardly under the action of the spring 17 whenever the upper reaches of the chains 9 and 9*a* move in a direction to the left, as viewed in FIG. 1, as well as when the transferring mechanism removes signatures 70 while the chains are idle. The bias of the spring 17 need not be strong; it should suffice to maintain the insert 19 in contact with the last signature 70 of the expiring stack 7 so as to prevent undesirable changes in orientation of such signature.

When the expiring stack 7 is exhausted to such an extent that a fresh stack 34 can or should be placed onto the upper reaches of the chains 9*a* behind the stack 7, the operator (or an automatic monitoring device, not shown) displaces the actuating member 51 to enable the valve element of the valve 50 to establish communication between the source 50*b* and the chamber of the motor 49. The motion transmitting member 47 moves upwardly and pivots the levers 28, 45 in directions to lift the carriage 30 above and away from the frame portion 12*b* so that the roller conveyors 31 in the platform 30*a* are located at a level above the upper reaches of the chains 9*a*. The bar 23 is inserted into the socket 25 in the front end portion of the carriage 30 before a crane or another suitable lifting device (not shown) lowers a relatively heavy and bulky fresh stack 34 onto the roller conveyors 31. The fresh stack 34 includes a column of parallel signatures 70, a first insert 19*a* in front of the foremost signature of the column, a second insert 9*b* behind the rearmost signature of the column, and one or more straps which are wound around the inserts 19*a*, 19*b* and the column of signatures therebetween.

The fresh stack 34 is thereupon pushed forwardly so that the insert 19*a* abuts against the bar 23. Such movement of the stack 34 can be effected with a minimum of effort because the stack 34 rests on the roller conveyors 31. In the next step, the pawl 38 is disengaged from the tooth 39 and the entire carriage 30 is pushed forwardly whereby the wheels 26 and 43 roll along the respective tracks of the frame portion 12*b*. The motor 29 shares such forward movement of the carriage 30 because it is mounted on the yoke 48 which is affixed to or forms part of the carriage.

Shortly before the carriage 30 reaches its front end position, (namely before the bar 23 reaches the pusher 20), the pusher 20 is pivoted to its inoperative position whereby the insert 19 is withdrawn from the space between the stacks 7 and 34. When the bar 23 abuts against the rearmost signature 70 of the stack 7, the strap or straps which surround the stack 34 are removed and the bar 23 is thereupon withdrawn from its socket 25 to thus remove the insert 19*a*. The carriage 30 can be advanced again to insure that the foremost signature of the fresh stack 34 abuts the rearmost signature 70 of the expiring stack 7.

The actuating member 51 is then caused to allow for escape of fluid from the chamber of the motor 49 so that the platform 30*a* of the carriage 30 descends to a level below the upper reaches of the chains 9*a*, i.e., the fresh stack 34 comes to rest on these chains. The pusher 20 (in its inoperative position) is pulled backwards (toward the rear end of the frame 12) and is pivoted back to its operative position to engage the rear side of the insert 19*b* and to urge the insert 19*b* against the rearmost signature 70 of the stack 34 under the bias of the stressed spring 17.

The carriage 30 can remain in its foremost position until the length of the expiring stack (such expiring stack first includes the remnant of the stack 7 plus the entire stack 34 and thereupon the stack 34) is reduced sufficiently to provide room for insertion of another fresh stack. The carriage 30 is pushed backwards so that the pallet of the pawl 38 engages the tooth 39 and the motor 49 is then caused to lift the carriage whereby the roller conveyors 31 in the platform 30*a* rise above the level of the upper reaches of the chains 9*a*. The manner in which a fresh stack is thereupon manipulated and moved to place its foremost signature 70 into contact with the rearmost signature of the expiring stack is the same as described above in connection with the stack 34.

An important advantage of the improved apparatus is that it consists of a relatively small number of rugged, simple and inexpensive parts, as well as that the number of controls is negligible. Though it is possible to provide the apparatus with suitable detector means which monitors the length of the expiring stack and is associated with suitable control means which effect automatic lifting, lowering, forward and rearward movements of the carriage 30, automatic pivoting of the pusher 20 to and from its operative position, as well as automatic movements of the pusher along the guide rod 18, such detectors and control means are optional because the provision of a wheel-mounted carriage, of the roller conveyor or conveyors on the platform of the carriage, and of the motor 49 renders it possible to place a fresh stack behind the expiring stack with a minimum of effort. The plane of the roller conveyors 31 is preferably parallel or nearly parallel to the upper reaches of the chains 9*a* in all positions of the carriage.

The improved apparatus is susceptible of many additional modifications without departing from the spirit of the invention. For example, the chains 9 and/or 9*a* can be replaced with belts or other endless flexible elements, the apparatus may comprise rests for the upper reaches of the chains 9 and 9*a*, the carriage 30 can be yieldably biased forwardly or rearwardily, the motor 49 can be replaced with an electric motor which moves the member 47 or the levers 28, 45 through the medium of a rack-and-pinion drive, the wheels 26 and/or 43 may be replaced with runners, and the carriage 30 can be dimensioned to receive two or more fresh stacks at a time. Also, the insert 19 can be removed by hand before the pusher 20 is pivoted to its inoperative position. The same applies for the insert 19*a* and bar 23.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for manipulating signatures in a bookbinding machine wherein successive signatures of an expiring stack of signatures are converted into a succession of discrete signatures, a combination comprising conveyor means having a front portion arranged to support and advance an expiring stack of signatures and a substantially horizontal elongated rear portion; a frame; a carriage mounted in said frame in the region of said rear portion and having a substantially horizontal support arranged to carry at least one fresh stack of signatures, said carriage being movable back and forth lengthwise of said rear portion; and means for moving said support with respect to said frame between a raised position in which said support is located at a level above said rear portion and a fresh stack which rests on said support can move with said carriage toward said front portion, and a lower position in which said support is located at a level below said rear portion whereby a fresh stack which has been placed onto said support in said raised position of said support comes to rest on said rear portion and the carriage can be moved away from said front portion.

2. A combination as defined in claim 1, wherein said carriage comprises wheels which contact and roll along said frame, at least while said carriage moves toward or away from said front portion of said conveyor means.

3. A combination as defined in claim 1, wherein said support includes at least one roller conveyor for fresh stacks to allow for movement of a fresh stack relative to said carriage in a direction toward said front portion of said conveyor means.

4. A combination as defined in claim 1, wherein said carriage comprises a front end portion nearer to said front portion of said conveyor means and a rear end portion, and further comprising removable abutment means provided on said front end portion to constitute a stop for a fresh stack on said support.

5. A combination as defined in claim 4, wherein each fresh stack has an insert which is located at the front end of a fresh stack when the latter rests on said support, said abutment means comprising a portion which removes the insert in front of a fresh stack on said support when said abutment means is removed from said front end portion of said carriage.

6. A combination as defined in claim 1, further comprising pusher means arranged to urge forwardly the rearmost signature of an expiring stack on said front portion of said conveyor means.

7. A combination as defined in claim 6, further comprising elongated guide means provided on said frame and extending in substantial parallelism with said rear portion, said pusher means being mounted on and being movable lengthwise of said guide means and said pusher means being further movable relative to an expiring stack on said front portion between a first position behind the rearmost signature of an expiring stack and a second position in which the foremost signature of a fresh stack can be moved into abutment with the rearmost signature of the expiring stack.

8. A combination as defined in claim 7, further comprising an insert disposed between said pusher and the rearmost signature of the expiring stack, said pusher having means for removing said insert from behind the rearmost signature of the expiring stack in response to movement of said pusher to said second position.

9. A combination as defined in claim 1, wherein said rear portion of said conveyor means comprises two spaced-apart parallel endless flexible elements having upper reaches which support the stacks, said support being disposed between said flexible elements.

10. A combination as defined in claim 1, wherein said means for moving said support comprises a fluid-operated motor mounted on said carriage.

11. A combination as defined in claim 1, wherein said means for moving said support comprises two levers pivoted to said carriage and having first arms adjacent to each other and second arms, wheels mounted on said second arms and engaging said frame, and motor means having means for pivoting said levers through the medium of said first arms whereby said levers pivot relative to said carriage and move said support upwardly with respect to said frame.

* * * * *